US007350383B1

(12) United States Patent
Kuo

(10) Patent No.: US 7,350,383 B1
(45) Date of Patent: Apr. 1, 2008

(54) ELECTRONIC LOCK

(76) Inventor: Ching-Hung Kuo, P.O. Box No. 6-57, Junghe (TW) 235

( * ) Notice: Subject to any disclaimer, the term of this patent is extended or adjusted under 35 U.S.C. 154(b) by 0 days.

(21) Appl. No.: 11/595,875

(22) Filed: Nov. 13, 2006

(51) Int. Cl.
*E05B 47/06* (2006.01)

(52) U.S. Cl. ..... 70/277; 70/107; 70/278.3; 70/278.7; 70/279.1; 70/283.1; 70/DIG. 6; 70/DIG. 30; 292/169.13; 292/169.14; 292/333

(58) Field of Classification Search ..... 70/277, 70/278.1, 278.2, 439, 278.3, 441, 278.7, 70/432, 279.1, 283, 283.1, DIG. 30, DIG. 59, 70/106–111, 257, DIG. 6; 292/144, 332, 292/333, 335, 169.13, 169.14
See application file for complete search history.

(56) References Cited

U.S. PATENT DOCUMENTS

| | | | | |
|---|---|---|---|---|
| 986,962 | A * | 3/1911 | Blank | 292/169.14 |
| 1,927,354 | A * | 9/1933 | Walker | 70/283 |
| 2,045,186 | A * | 6/1936 | Honsel | 70/279.1 |
| 3,796,073 | A * | 3/1974 | Guiraud | 70/134 |
| 4,685,709 | A * | 8/1987 | Kambic | 292/201 |
| 5,666,830 | A * | 9/1997 | Litvin | 70/129 |
| 6,644,072 | B1 * | 11/2003 | Hsieh | 70/107 |
| 6,899,361 | B2 * | 5/2005 | Dorn | 292/332 |
| 7,155,946 | B2 * | 1/2007 | Lee et al. | 70/107 |
| 2002/0092331 | A1 * | 7/2002 | Huang | 70/107 |

* cited by examiner

*Primary Examiner*—Lloyd A. Gall
(74) *Attorney, Agent, or Firm*—Troxell Law Office, PLLC

(57) ABSTRACT

The present invention provides an electronic lock structured to include a first bolt configured with an elastic clasp, an electromagnetic device connected to an input device, a second bolt and a microswitch connected to a security system, all of which are installed interior of a housing of the electronic lock. The elastic clasp is retained by a protruding edge of the housing, thereby disenabling the first bolt from an arbitrary retracting movement that would otherwise render the lock incapable of being unlocked. The input device controls the electromagnetic device to induce the elastic clasp and release a retaining state, and then directly rotating a rotating button causes a retracting movement of the first bolt and unlocking of the electronic lock, which simultaneously disconnects the security system. After unlocking, a front end of the second bolt protrudes out from the housing, whereupon a protruding base of the second bolt is used to press a steel ball, thereby enabling the second bolt to form a substantially stable position, which ensures effective prevention of mistaken locking and avoids forgetting to lock. Moreover, when in a locked state, the second bolt retracts within the housing and triggers the microswitch to activate the security system, thereby providing the present invention with security and convenience of operation.

3 Claims, 6 Drawing Sheets

ELECTRONIC LOCK

BACKGROUND OF THE INVENTION (a) Field of the Invention

The present invention relates to an electronic lock, and more particularly to an electronic lock structured to include an input device that controls an electromagnetic device to release a retaining state and enable unlocking by functioning in coordination with a rotating button. Moreover, after unlocking, a second bolt is used to form a stable fixed position, which ensures effective prevention of mistaken locking and avoids forgetting to lock. Furthermore, a microswitch is triggered to activate a security system when the second bolt is retracted, thereby providing a secure electronic lock that is convenient to operate.

(b) Description of the Prior Art

In order to achieve the objectives of preventing illegal opening, while at the same time being provided with confidentiality and convenience of opening, locksets used in conventional vaults and safes are all designed with two keys that are respectively inserted into two keyholes located at different positions on the lockset, and the locksets can only be opened by the two keys simultaneously actuating lock core devices within the lockset. Although such locksets provide a measure of safety, however, two sets of the lock core devices must be installed within the lockset to affect a mutual linkage movement. Hence, shortcomings common in such types of locksets of prior art include the inability to reduce size, a relatively complicated internal mechanism, high cost of manufacture, the inconvenience of repair after damage, and so on.

In addition, the majority of both traditional mechanical locks and electromagnetic locks have installed a second bolt, the freely retractable characteristic of which is used to prevent mistakenly locking and avoid forgetting to lock the mechanical lock or the electromagnetic lock. However, the freely retractable movement of the aforementioned second bolt mechanism as seen in prior art results in poor functionality to prevent mistakenly locking a door of a vault or safe. Moreover, a user is unable to detect whether or not the door is really locked after closing the door, resulting in annoyance when operating such prior art locksets.

SUMMARY OF THE INVENTION

In light of the above, the present invention provides a new generation secure electronic lock, which is able to effectively improve the shortcomings and annoyances of the aforementioned prior art locksets.

A primary objective of the present invention is to provide an electronic lock that is convenient to operate by using an input device to control an electromagnetic device located interior of the lock to release a retaining state, whereupon a rotating button on the lock is directly rotated, which simultaneously disconnects an external security system.

Another objective of the present invention is to provide the electronic lock with security by enabling, after unlocking and disconnection of the external security system, and after a front end of a second bolt protrudes out from a housing, a protruding base of the second bolt to be used to press a steel ball, thereby enabling the second bolt to form a substantially stable position, which ensures effective prevention of mistaken locking and avoids forgetting to lock. Moreover, when in a locked state, the second bolt retracts within the housing, and an end of the second bolt appropriately triggers a microswitch to activate a security system.

In order to achieve the aforementioned objectives, the present invention adopts the following technological scheme:

The electronic lock of the present invention is structured to comprise a first bolt configured with an elastic clasp, an electromagnetic device connected to an input device, a second bolt and a microswitch connected to a security system, all of which are installed interior of a housing of the electronic lock.

The aforementioned first bolt can be directly controlled by a rotating button external of the lock, thereby enabling the first bolt to protrude out or retract into the housing.

The first bolt comprises a Y-shaped extended section, one of the ends of which has the elastic clasp attached thereto. The elastic clasp is retained by a protruding edge of the housing, thereby disenabling the first bolt from an arbitrary retracting movement that would otherwise render the lock incapable of being unlocked.

Another of one of the ends of the Y-shaped extended section has a spring attached thereto, thereby providing the first bolt with outward protruding elasticity.

The aforementioned electromagnetic device is positioned at an upper end of the extended section of the first bolt interior of the housing, thereby enabling an electromagnetic inductive surface of the electromagnetic device to appropriately correspond to the aforementioned elastic clasp. The electromagnetic device is connected to the input device using a conducting wire, and entering a correct password into the input device enables activation of the electromagnetic device, whereupon electromagnetic induction causes movement of the elastic clasp that releases a retaining state between the elastic clasp and the protruding edge of the housing, and which simultaneously disconnects the external security system.

The aforementioned second bolt is positioned above the first bolt interior of the housing. When locking, the first bolt protrudes into a lockhole, and the second bolt retracts within the interior of the housing. When unlocking, the first bolt retracts within the interior of the housing, and the second bolt protrudes out from the housing. Hence, the freely retractable characteristic of the second bolt is used to prevent mistaken locking.

The aforementioned microswitch is positioned at an end of the second bolt, and retracting of the second bolt within the interior of the housing triggers the microswitch to activate the security system.

According to the aforementioned description of the present invention, when unlocking, the input device controls the electromagnetic device to electromagnetically induce the elastic clasp and release a retaining state, and then directly rotating a rotating button causes a retracting movement of the first bolt and unlocking of the electronic lock, which simultaneously disconnects the security system, thereby providing the present invention with convenience of operation.

After unlocking, a front end of the second bolt protrudes out from the housing, whereupon the protruding base of the second bolt is used to press the steel ball, thereby enabling the second bolt to form a substantially stable position, which ensures effective prevention of mistaken locking and avoids forgetting to lock, thus providing the present invention with security.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
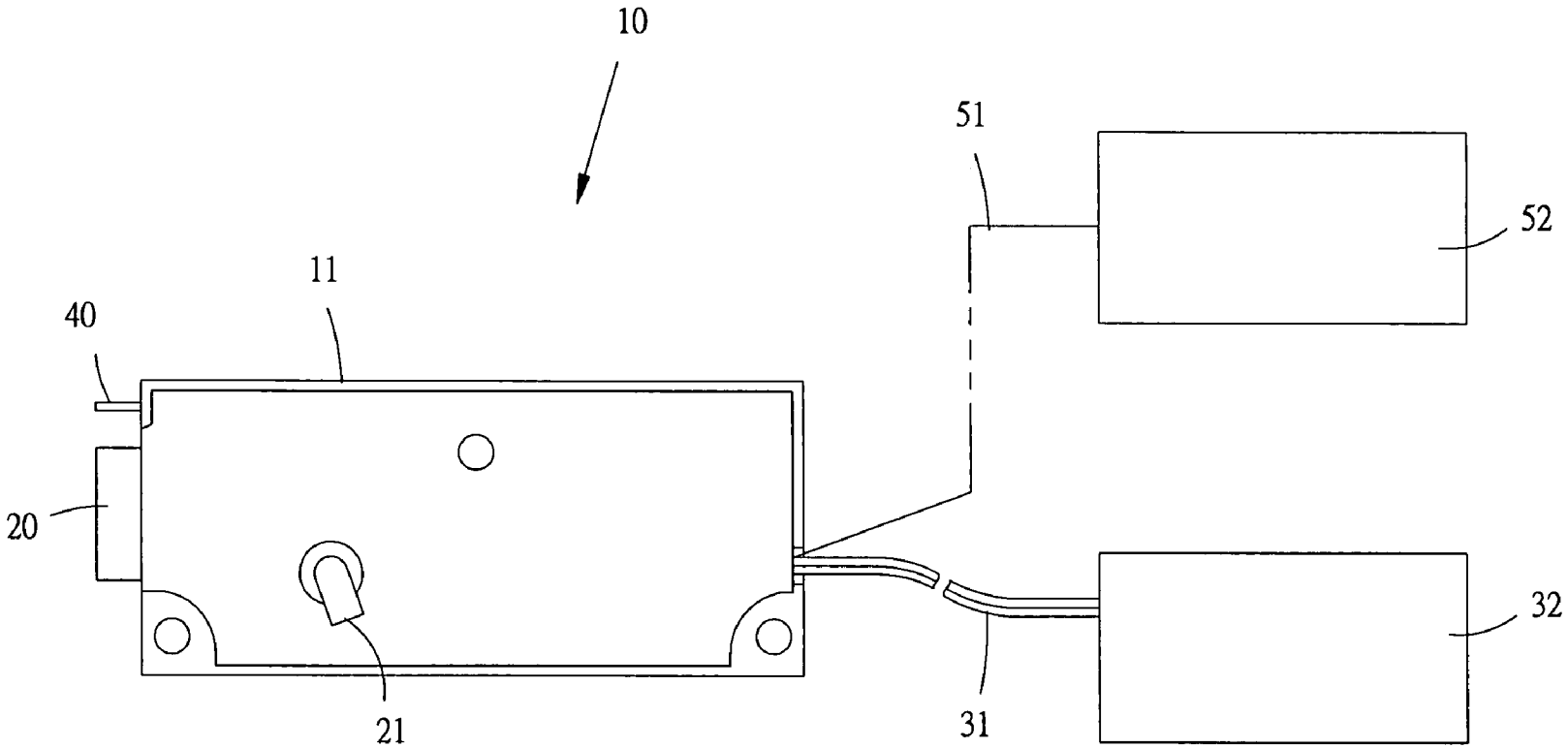
FIG. 1 shows a schematic view of an electronic lock connected to an input device and a security system according to the present invention.

Referring to FIG. 1, which shows a schematic view of an electronic lock 10 of the present invention connected to an input device 32 and an external security system 52.

Figure 2:
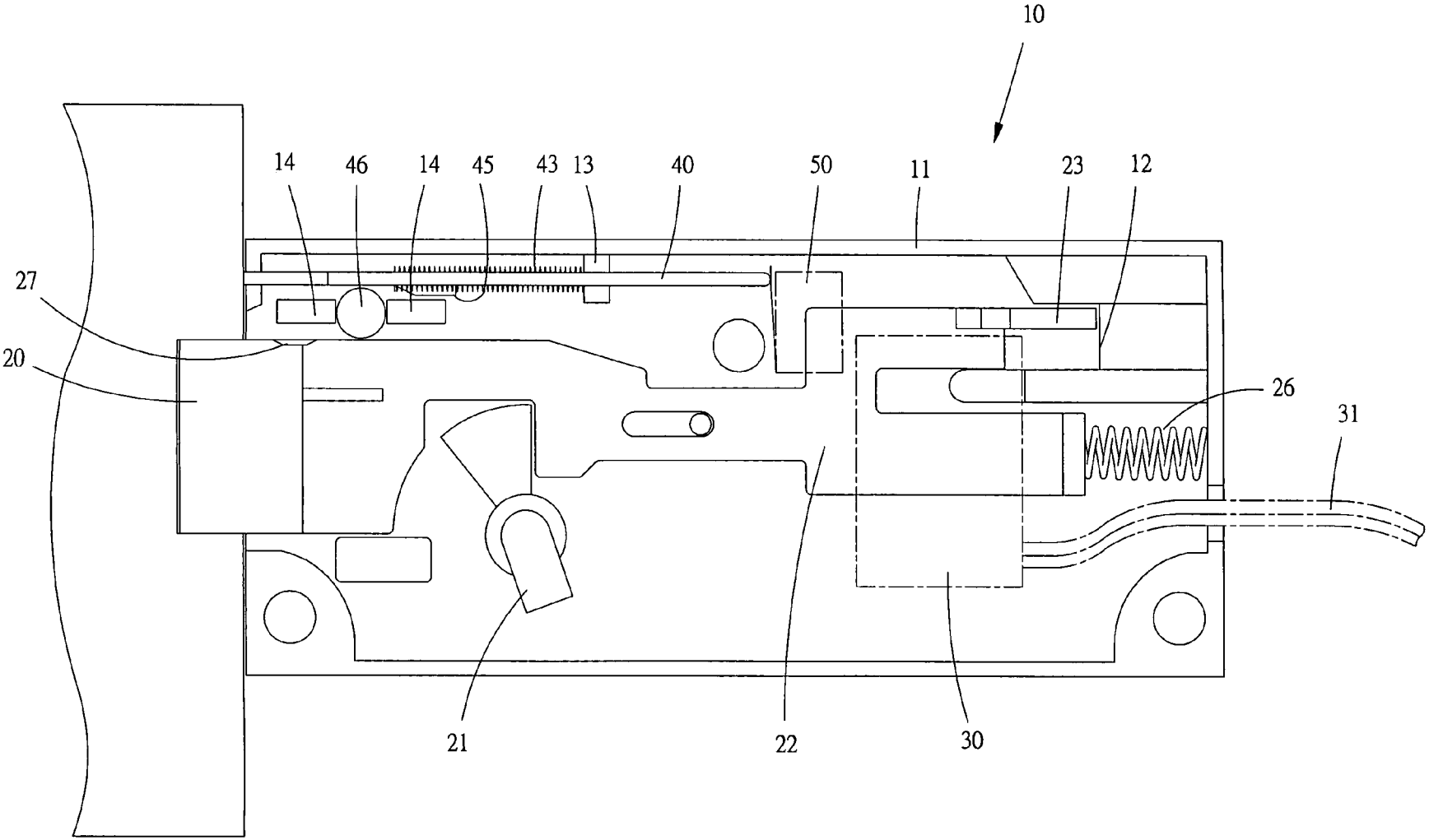
FIG. 2 shows a planar view of component members of the electronic lock according to the present invention.

Referring to FIG. 2, which shows a planar view of internal component members of the electronic lock 10 of the present invention depicting the electronic lock 10 in a locked state, wherein a protruding first bolt 20 is already clamped within a lockhole, and a second bolt 40 is retracted within the interior of a housing 11, at which time an end of the second bolt 40 triggers a microswitch 50 to activate the security system 52.

Referring to FIG. 1 and FIG. 2, which show the electronic lock 10 of the present invention structured to comprise the first bolt 20 configured with an elastic clasp 23, an electromagnetic device 30 connected to the input device 32, the second bolt 40 and the microswitch 50 connected to the security system 52, all of which are installed interior of the housing 11 of the electronic lock 10.

Figure 3:
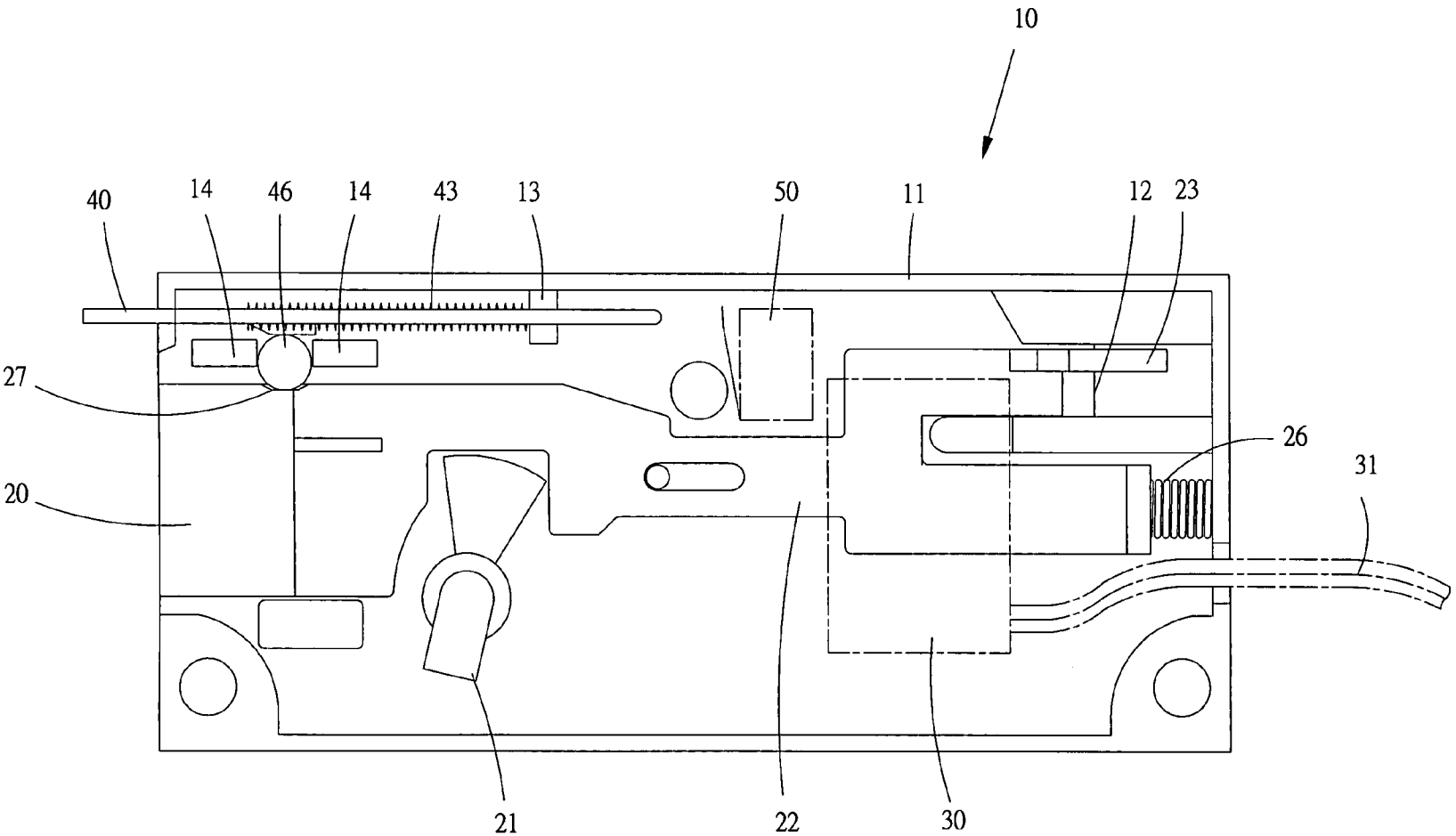
FIG. 3 shows a planar view of component members of the electronic lock according to the present invention.

Referring to FIG. 3, which shows a planar view of internal component members of the electronic lock 10 of the present invention depicting the electronic lock 10 in an unlocked state, wherein the first bolt 20 is retracted within the interior of the housing 11, and a front end of the second bolt 40 protrudes out of the housing 11.

Referring to FIG. 2 and FIG. 3, a rotating button 21 external of the housing 11 of the electronic lock 10 is able to directly control the aforementioned first bolt 20 to enable the first bolt 20 to protrude from or retract into the housing 11.

The first bolt 20 comprises a Y-shaped extended section 22, and the elastic clasp 23 is disposed at one of the ends of the Y-shaped extended section 22. The elastic clasp 23 is retained by a protruding edge 12 of the housing 11, thereby disenabling the first bolt 20 from an arbitrary retracting movement that would otherwise render the electronic lock 10 incapable of being unlocked.

A spring 26 is disposed at another of one of the ends of the Y-shaped extended section 22 to provide the first bolt 20 with outward protruding elasticity.

Figure 4:
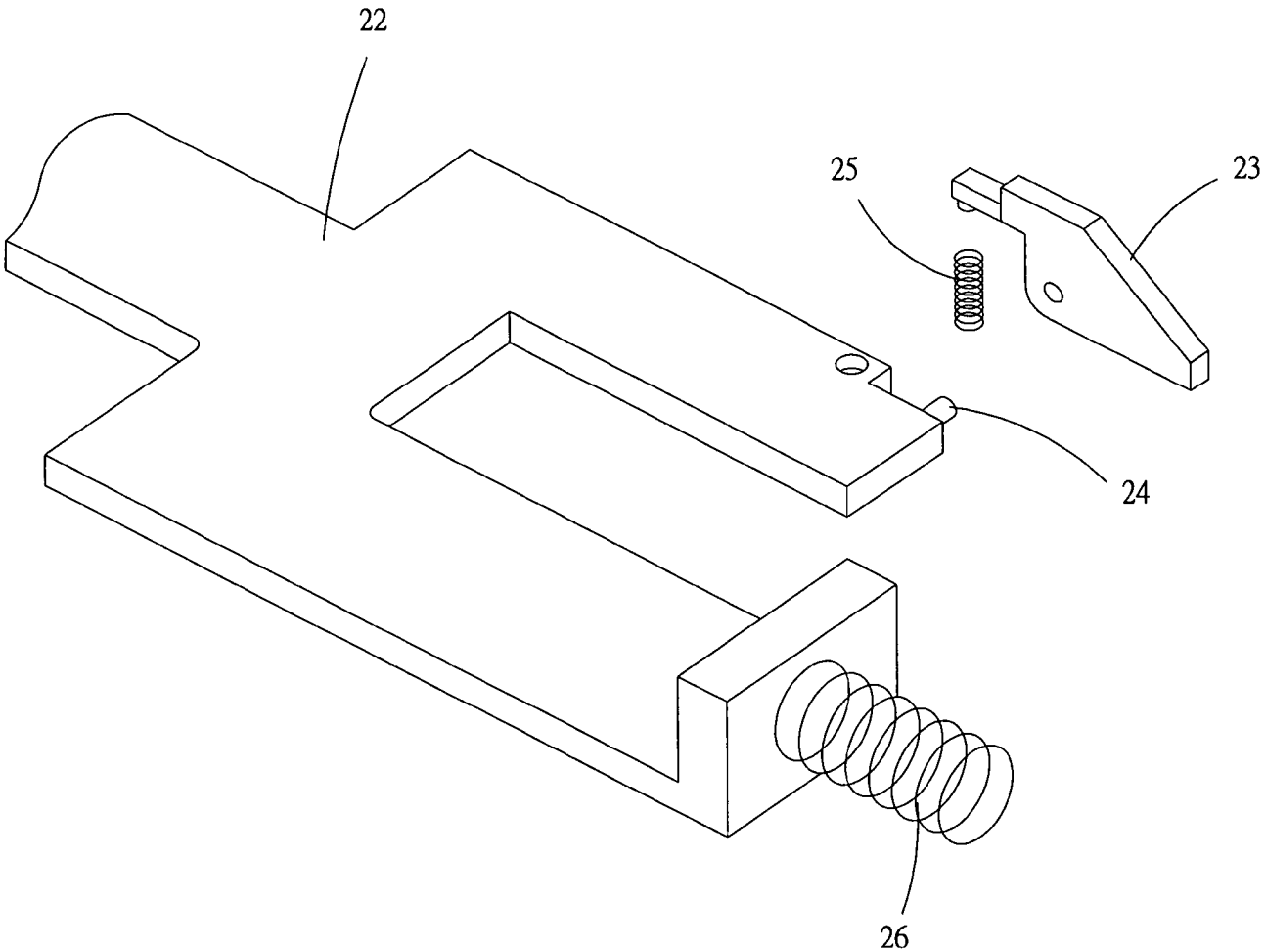
FIG. 4 shows an exploded view of an elastic clasp and a spring at an end of a Y-shaped extended section of a first bolt of the electronic lock according to the present invention.

Referring to FIG. 4, which shows the elastic clasp 23 and the spring 26 located at the ends of the Y-shaped extended section 22 of the first bolt 20 of the electronic lock 10 of the present invention, wherein the elastic clasp 23 component member is depicted disassembled from the Y-shaped extended section 22.

Figure 5:
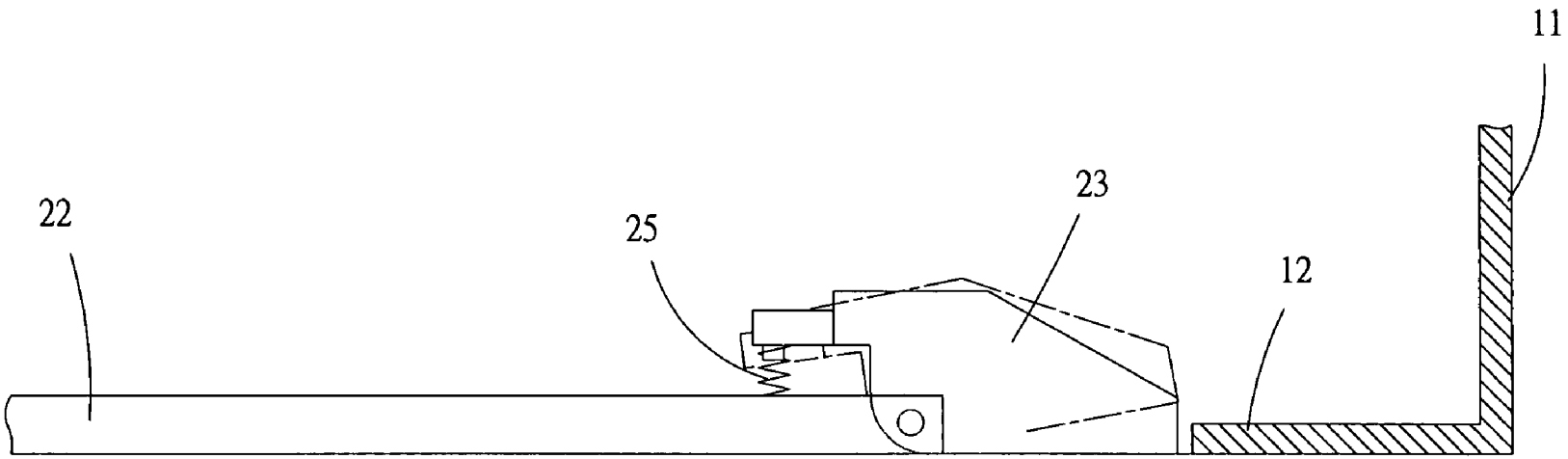
FIG. 5 shows a schematic view depicting movement of the elastic clasp at the end of the Y-shaped extended section of the first bolt of the electronic lock according to the present invention.

FIG. 5 shows a schematic view depicting movement of the elastic clasp 23 at the end of the Y-shaped extended section 22 of the first bolt 20 of the electronic lock 10 of the present invention.

Referring again to FIG. 4, the aforementioned elastic clasp 23 is pivotal attached to a pivot shaft 24 located at one of the ends of the Y-shaped extended section 22 of the first bolt 20, and a spring 25 is disposed between the elastic clasp 23 and the end of the extended section 22. A front end of the elastic clasp 23 is forced downward when subjected to elastic tension, and is appropriately retained by the protruding edge 12 of the housing 11, as depicted in FIG. 5 and FIG. 2, thereby disenabling the first bolt 20 from an arbitrary retracting movement that would otherwise render the electronic lock 10 incapable of being unlocked.

Referring again to FIG. 1 and FIG. 2, the aforementioned electromagnetic device 30 positioned at an upper end of the Y-shaped extended section 22 of the first bolt 20 enables an electromagnetic inductive surface of the electromagnetic device 30 to appropriately correspond to the aforementioned elastic clasp 23. The electromagnetic device 30 is connected to the input device 32 using a conducting wire 31, and the electromagnetic device 30 is actuated by entering the correct password into the input device 32, whereupon electromagnetic induction causes movement of the elastic clasp 23. Referring to FIG. 5, wherein the dotted line depicts the already electromagnetically induced elastic clasp 23, which has released a retaining state between the elastic clasp 23 and the protruding edge 12 of the housing 11.

According to the aforementioned description, when unlocking the electronic lock 10, the correct password must be first entered into the input device 32, thereby controlling the electromagnetic device 30 interior of the electromagnetic lock housing 11 to electromagnetically induce the elastic clasp 23 to release the retaining state and simultaneously disconnect the external security system 52, whereupon the rotating button 21 is directly rotated to control retracting movement of the first bolt 20 and unlock the electronic lock 10.

Figure 6:
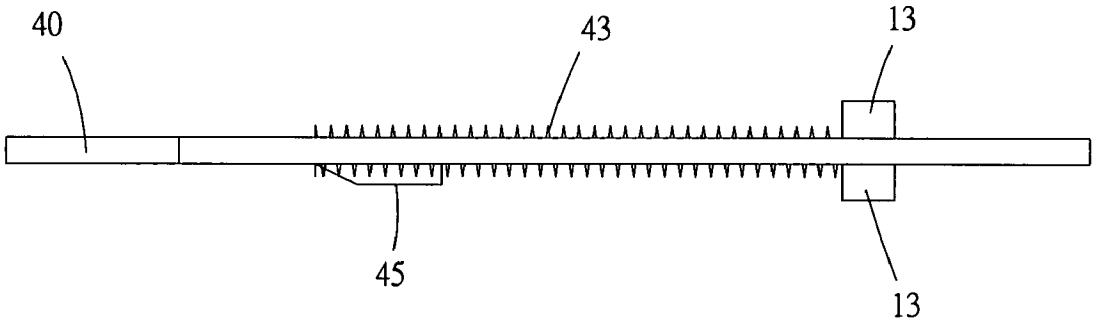
FIG. 6 shows a top view of a second bolt of the electronic lock according to the present invention.

FIG. 6 shows a top view of the second bolt 40 of the electronic lock 10 of the present invention.

Figure 7:
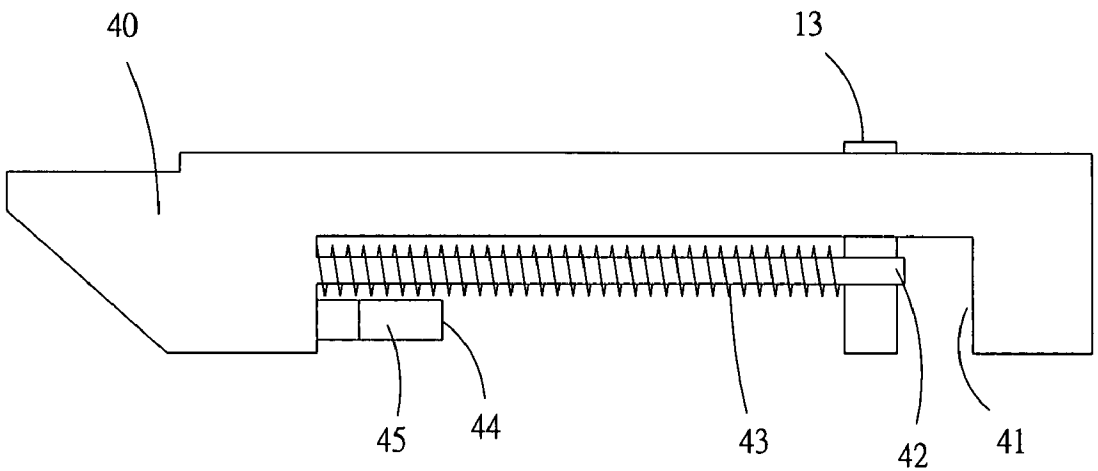
FIG. 7 shows a side view of the second bolt of the electronic lock according to the present invention.

FIG. 7 shows a side view of the second bolt 40 of the electronic lock 10 of the present invention.

Referring to FIGS. 2 and 3 and FIGS. 6 and 7, when locking the electronic lock 10, the first bolt 20 protrudes into the lockhole and the aforementioned second bolt 40 positioned above the first bolt 20 interior of the housing 11 retracts within the interior of the housing 11, as depicted in FIG. 2. When unlocking, the first bolt 20 retracts within the interior of the housing 11 and the second bolt 40 protrudes out from the housing 11, as depicted in FIG. 3. The freely retractable characteristic of the second bolt 40 is used to prevent mistakenly locking the electronic lock 10.

The aforementioned microswitch 50 positioned at an end of the second bolt 40 is triggered when the second bolt 40 retracts within the interior of the housing 11, whereupon the security system 52 is activated through a conducting wire 51, as shown in FIG. 1.

The second bolt 40 includes an indentation 41 defined in a bottom edge thereof, as depicted in FIG. 7. A first horizontal bar 42 and a second horizontal bar 44 are located interior of the indentation 41, and a spring 43 is mounted on the first horizontal bar 42. A protruding base 45 protrudes from a side end surface of the second horizontal bar 44. A steel ball 46 is positioned between the first bolt 20 and the second bolt 40 within a space between two protruding bases 14 protruding from a bottom edge of the housing 11, as depicted in FIG. 2.

After assembling the second bolt 40, an end of the spring 43 makes contact with two protruding bases 13 of the bottom edge of the housing 11, thereby providing the second bolt 40 with outward protruding elasticity. Hence, when unlocking, the second bolt 40 automatically protrudes out from the housing 11, as depicted in FIG. 3, at which time the outward protruding second bolt 40 enables the protruding base 45 of the second horizontal bar 44 to press the steel ball 46 downward, thereby fixedly positioning the steel ball 46 within a recess 27 predefined on the first bolt 20.

Configurational design of the present invention includes providing the protruding base 45 with a protruding thickness greater than concavity depth of the recess 27, hence, outward protruding movement of the aforementioned second bolt 40 enables the protruding base 45 to press the steel ball 46, thereby enabling the second bolt 40 to obtain a substantially stable position, and forestalling it from easily retracting within the housing 11, thus ensuring effective prevention of mistaken locking and avoiding forgetting to lock.

When locking, a pushing force of a closing door is used to cause the second bolt 40 to retract within the housing 11, at which time inward displacement causes the protruding base 45 to move away from the steel ball 46, thereby releasing the aforementioned pressed state. Moreover, retraction of the second bolt 40 triggers the microswitch 50 which actuates the security system 52, as depicted in FIG. 2, at which time rotation of the rotating button 21 controls outward protrusion of the first bolt 20 into the lockhole, thereby completing locking of the electronic lock 10.

In short, according to the aforementioned description of the present invention, when unlocking, the correct password need only be entered to enable direct rotating of the rotating button 21 and simultaneous disconnection of the security system 52, thereby providing the present invention with convenience of operation.

In addition, a configuration whereby use of the second bolt 40 functioning in coordination with the steel ball 46 and the microswitch 50 enables the second bolt 40 to form a substantially stable position, and ensures effective prevention of mistaken locking and avoids forgetting to lock. Moreover, the microswitch 50 is immediately triggered to activate the security system 52 when the second bolt 40 retracts within the housing 11, thereby achieving the objective of increased security.

In conclusion, the present invention assuredly achieves anticipated functionality and objectives. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An electronic switch, comprising:

a first bolt that is directly controlled by a rotating button to enable the first bolt to outwardly protrude from or retract within a housing, an elastic clasp is located at an end of the first bolt, and the elastic clasp is retained by a protruding edge of the housing, thereby disenabling the first bolt from an arbitrary retracting movement;

an electromagnetic device positioned at an upper end of an extended section of the first bolt interior of the housing, an electromagnetic inductive surface of the electromagnetic device appropriately corresponds to the elastic clasp, the electromagnetic device is connected to an input device using a conducting wire; entering of a correct password into the input device activates the electromagnetic device to induce movement of the elastic clasp, thereby releasing a retaining state between the elastic clasp and the protruding edge of the housing, and simultaneously disconnecting a security system;

a second bolt positioned above the first bolt interior of the housing;

when locking, the first bolt protrudes into a lockhole and the second bolt retracts within the interior of the housing; when unlocking, the first bolt retracts within the interior of the housing and the second bolt protrudes out of the housing; thus, the freely retractable characteristic of the second bolt is used to prevent mistaken locking; and a microswitch connected to the security system, and positioned at an end of the second bolt; when the second bolt retracts within the interior of the housing, then the second bolt triggers the microswitch and activates the security system through a conducting wire.

2. The electronic switch according to claim 1, wherein the first bolt comprises a Y-shaped extended section, and the elastic clasp is disposed on one of the ends of the Y-shaped extended section, the elastic clasp is pivotally attached to a pivot shaft located at the end of the Y-shaped extended section, and a spring is disposed between the elastic clasp and the end of the extended section; a front end of the elastic clasp is forced downward when subjected to elastic tension, and is appropriately retained by the protruding edge of the housing, thereby disenabling the first bolt from an arbitrary retracting movement that would otherwise render the electronic switch incapable of being unlocked.

3. The electronic switch according to claim 1, wherein the first bolt comprises a Y-shaped extended section, and a spring is disposed on an end of the Y-shaped extended section, thereby providing the first bolt with outward protruding elasticity.

* * * * *